United States Patent [19]

Clarke

[11] 4,431,167

[45] Feb. 14, 1984

[54] ADAPTOR

[75] Inventor: Ronald A. Clarke, Macleod, Australia

[73] Assignee: The BOC Group plc, London, England

[21] Appl. No.: 398,749

[22] Filed: Jul. 16, 1982

[51] Int. Cl.[3] ..... B23K 7/00

[52] U.S. Cl. ..... 266/48

[58] Field of Search ..... 266/48; 148/9 R

[56] References Cited

U.S. PATENT DOCUMENTS 3,948,496 3/1976 Miller ..... 266/48

FOREIGN PATENT DOCUMENTS 493088 10/1938 United Kingdom .
736609 9/1955 United Kingdom .
1217629 12/1970 United Kingdom .

*Primary Examiner*—W. Stallard
*Attorney, Agent, or Firm*—David A. Draegert; Larry R. Cassett

[57] ABSTRACT

An adaptor for interconnecting a three outlet cutting torch head with a two inlet cutting tip. When installed, the adaptor provides a cavity for mixing combustible gas with heating oxygen. The configuration of the cavity and associated passageways minimizes the possibility of flame blowback into the head.

8 Claims, 7 Drawing Figures

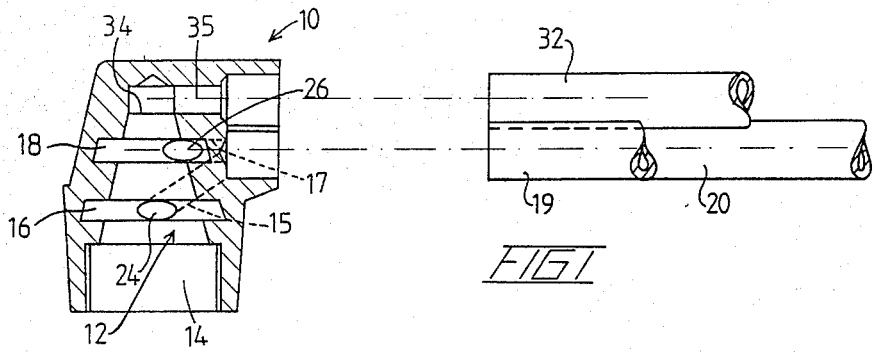
FIG1
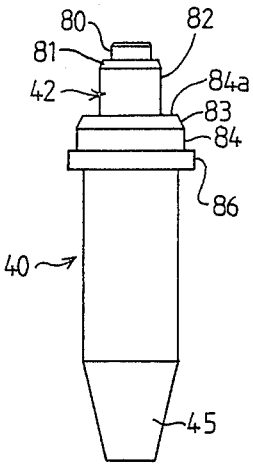
FIG2
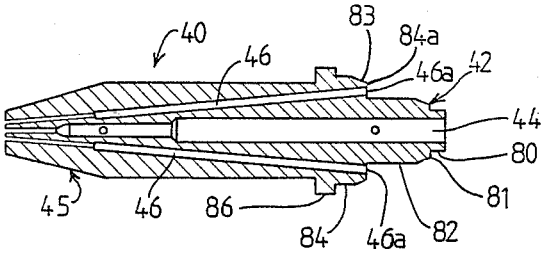
FIG3
FIG4
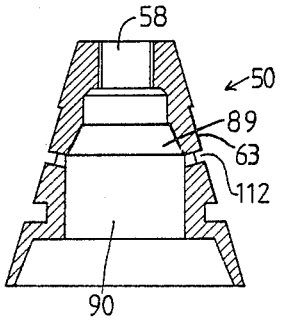
FIG5
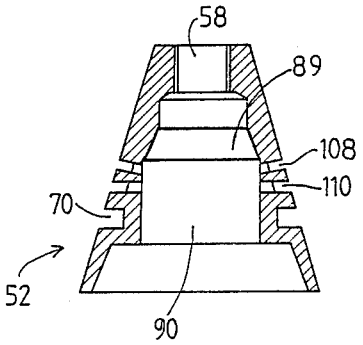

ADAPTOR

This invention relates to cutting torches and in particular to an adaptor for use in interconnecting a head of a cutting torch with a cutting torch tip.

Gas fired cutting torches usually have a head to which combustible gas and cutting oxygen are supplied, the head receiving a separable tip having passageways for flow therethrough of combustible gas and cutting oxygen. The separable tip is used because the tip is liable to damage through the effects of heat and otherwise in use and, by making the tip removable, replacement of portion only of the torch, namely the tip, is usually necessary when such damage occurs. Again, the removability of the tip permits ready modification of the torch to suit particular requirements, such as particular combustible gases and particular operating conditions merely by substituting tips different designs. Generally, the aforementioned head recess which receives the tip is of inwardly convergent tapered form and the tip end which interfits therewith is of a corresponding tapered form also.

In some designs of cutting torch, the torch has three gas flow lines to the head, these separately communicating with the head recess at respective inlet ports on the surface defining the recess. Cutting tips designed for use with such heads have hitherto been provided with three inlet ports on the tapered end portion thereof and which, when the tip is fitted into the head, communicate respectively and individually with ones of the three outlet ports. In use, cutting oxygen is supplied to one of the outlet ports and thence flows to one inlet port in the tip and thence through the tip and exteriorly thereof at its outer end. On the other hand, combustible gas and oxygen are supplied separately to the other two outlet ports and flow therefrom to respective ones of the inlet ports. In this case, the cutting tip is provided in its interior with a mixing chamber into which the combustible gas and oxygen from the last two mentioned ports flows for mixing. From the internal mixing chamber, the resultant combustible gas and oxygen mixture flows through the tip to exit exteriorly of the outer end of the tip for burning.

In an alternative design of cutting torch, the cutting head instead of being provided with the aforementioned three outlet ports is provided with only two outlet ports which communicate with the recess in the head and the tip has, correspondingly, only two inlet ports. To one of the head outlet ports, cutting oxygen is supplied and, as in the case with a three outlet head, this flows to the tip via one of tip inlet ports to thence pass through tip to emerge from the tip at its outer end. In this case, the other outlet of the head receives a mixture of combustible gas and is positioned to provide direct communication with the other inlet on the tip so that the gas/oxygen mixture in use flows into the tip via that inlet to be directed along a passageway in the tip to the outer end of the tip.

Generally, it is often less expensive to manufacture two outlet cutting heads and mating cutting tips, at least since the cutting tip does not require incorporation thereinto of the necessary mixing chamber for the combustible gas and oxygen. However, the incorporation of the mixing chamber in the cutting tip itself as with three outlet designs results in a construction where the mixing chamber is relatively close to the outer end of the tip. On the other hand, since in any event mixing of the combustible gas and oxygen must occur somewhere, there is with two outlet designs invariably provided a mixing chamber within the body of the torch itself. Now it occurs that occasionally due to improper operating conditions a certain phenomena arise involving so-called "blow back", "flash back" or "back fire" of the combustible gas and oxygen mixture from the outer end of the tip and back through the supply passageways thereto. This condition is characterised in that the gas-/oxygen mixture instead of burning exteriorly of the tip burns back thereinto and through the mixed gas supply passages to the mixing chamber. In some circumstances this condition can become dangerous and if such internal burning is sustained within the mixing chamber, destruction of the cutting torch will result. In the case where the mixing chamber is close to the outer end of the cutting tip, such as in the case of a three outlet cutting head, it is relatively unlikely that blow back will occur to locations back into the torch body past the tip.

An object of the invention is to provide means whereby the advantage of relative cheapness when employing two inlet cutting tips can be achieved together with at least siome of the advantage of using a three outlet cutting head.

In accordance with one aspect of the invention there is provided an adaptor for interconnecting a three outlet cutting torch head with a two inlet cutting tip, said cutting head having an inwardly convergent recess therein and first, second and third outlet ports communicating with said recess for delivery of cutting oxygen, heating oxygen and combustible gas respectively to the recess of said head, and said cutting tip having respective first and second inlet ports for cutting oxygen and a mixture of combustible gas and heating oxygen, said first and second inlet ports being on a tapered portion of the tip, said adaptor having an inwardly convergent recess for receiving said tapered portion of said tip and a tapered portion for fitment of the attachment into said recess of the head; said adaptor being formed whereby in use with said tapered portion thereof inserted into said recess in said head and said tapered portion of said tip inserted into said recess of said adaptor, communication is provided, via first passageway means, between the first outlet port and the first inlet port and, via second passageway means, between both said second and third outlet ports and the second inlet port, said second passageway means having therein a first portion through which, in use, both of said combustible gas and heating oxygen flow, said first portion being elongate in the direction of flow therethrough and being of small cross-sectional size at least in one direction transverse to the direction of flow.

The invention also provides in combination, a cutting head, adaptor and cutting tip as described above.

The invention is further described by way of example with reference to the accompanying drawings in which:

FIG. 1 is a diagrammatic cross-section of the head of a conventional three outlet oxygen cutting torch;

FIG. 2 is a side view of a conventional cutting tip designed for use with a two outlet cutting head;

FIG. 3 is an axial section of the tip of FIG. 2;

FIGS. 4 and 5 show two alternative forms of adaptor for permitting fitting of the tip of FIGS. 2 and 3 to the head of FIG. 1;

Figure 6:
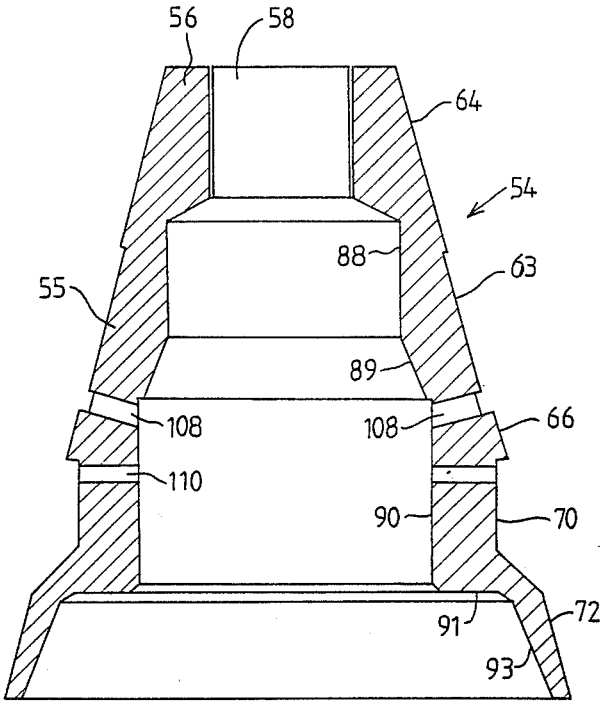
FIG. 6 is an enlarged cross-sectional view of an alternative form of adaptor for use in fitting the tip of FIG. 2 to the head of FIG. 1.

Referring firstly to FIG. 1, there is shown therein a head 10 of a three outlet oxygen cutting torch. The head 10 is of conventional configuration having a generally conical recess 12 which converges from an open mouth portion 14. Recess 12 has two annular grooves 16, 18 therein. Passageways 15, 17 for supply of heating gas and heating oxygen to the grooves 16, 18 from supply pipes 19, 20 respectively are provided. The passageways 15, 17 communicate with respective inlet ports 24, 26 in the grooves 16, 18. A cutting oxygen supply pipe 32 also communicates via a passageway 35 to a cutting oxygen inlet port 34 at the top of the recess 12.

Head 10 is adapted for interconnection with a tapered end portion of a three inlet cutting tip (not shown). When the tip is inserted into the head, oxygen is supplied from port 34 to pass through the tip and exit at the end of the tip remote from the head, whilst heating gas and oxygen are supplied from the ports 24, 26 to a mixing chamber in the tip from whence the heating gas and oxygen mixture is expressed from the remote end of the tip. In accordance with usual practice, the oxygen for cutting is supplied to a central opening at the remote end of the tip and the heating gas oxygen mixture would be supplied to a ring of outlets around the cutting oxygen outlet. In use, the burnt heating oxygen and gas mixture is utilized to heat a metal article which is to be cut and the cutting oxygen effects cutting by oxidization of the heated article.

FIGS. 2 and 3 show a two inlet cutting tip 40 having a tapered end portion 42 and a nozzle end portion 45. This cutting tip has a central bore 44 therethrough and a series of smaller bores 46 extending from locations arrayed around an outstanding surface portion 84*a* of tip portion 42, through the interior of the tip of the nozzle end portion 45. Tip 40 is designed for use with a cutting head different to the cutting head 10 shown in FIG. 1. More particularly, the tip 40 is designed for use with a cutting head in which the heating gas and oxygen are supplied in pre-mixed form to the head rather than separately.

FIGS. 4, 5 and 6 show three different forms of adaptor 50, 52 and 54 usable to adapt the head 10 to permit the tip 40 to be used therewith.

Referring firstly to FIG. 6, the adaptor 54 shown therein is of hollow generally frustoconical form having a wall 55 of generally annular cross-section and which is divergent when viewed in axial section. At one end, the adaptor 54 has a transverse wall 56 with a central opening 58 therein. The outer surface of the adaptor 54 has a taper corresponding to the taper of the recess 12 of head 10 so that the adaptor can fit into the recess 12 in the manner shown in FIG. 7. Similarly, the interior surface of the wall 55, although of complex form is nevertheless of generally inwardly tapered configuration arranged in such a fashion as to permit insertion and reception of the end portion 42 of a tip 40 into the adaptor. Thus, the adaptor 54 is in use arranged as in FIG. 7 with the adaptor received in head 10 and the tip 40 received in the adaptor. Then the port 34 from the head 10 communicates, via the opening 58 in end wall 56 of the adaptor, with the central bore 44 through the tip so that cutting oxygen is supplied through the central adaptor opening 58 to the tip for operation thereof.

The outside surface of adaptor 54 has a shallow groove 63 of frustoconical configuration and preferably of depth in the range 0.06 to 0.08 mm. Groove 63 is so arranged that, when the adaptor is positioned in the head 10, the groove 18, and thus the heating oxygen outlet 26 in the head, communicate with a chamber 62 defined between the cutting head and the adaptor 54 at the location of the groove. As shown, the chamber 62 is of annular form in axial section and of generally frustoconical overall configuration. The inner surface of chamber 62 is defined by the base surface of groove 63 and its outer surface is defined by the spaced, generally parallel, surface of the head recess 12. The groove 18 is, when the adaptor is positioned in the head, located so as to communicate with the top end of the chamber 62. The chamber 62 is sealed at upper and lower parts thereof by inter-engagement between the outer surface of the adaptor, at the surface portions 64, 66 indicated, with the surface of the head recess.

Figure 7:
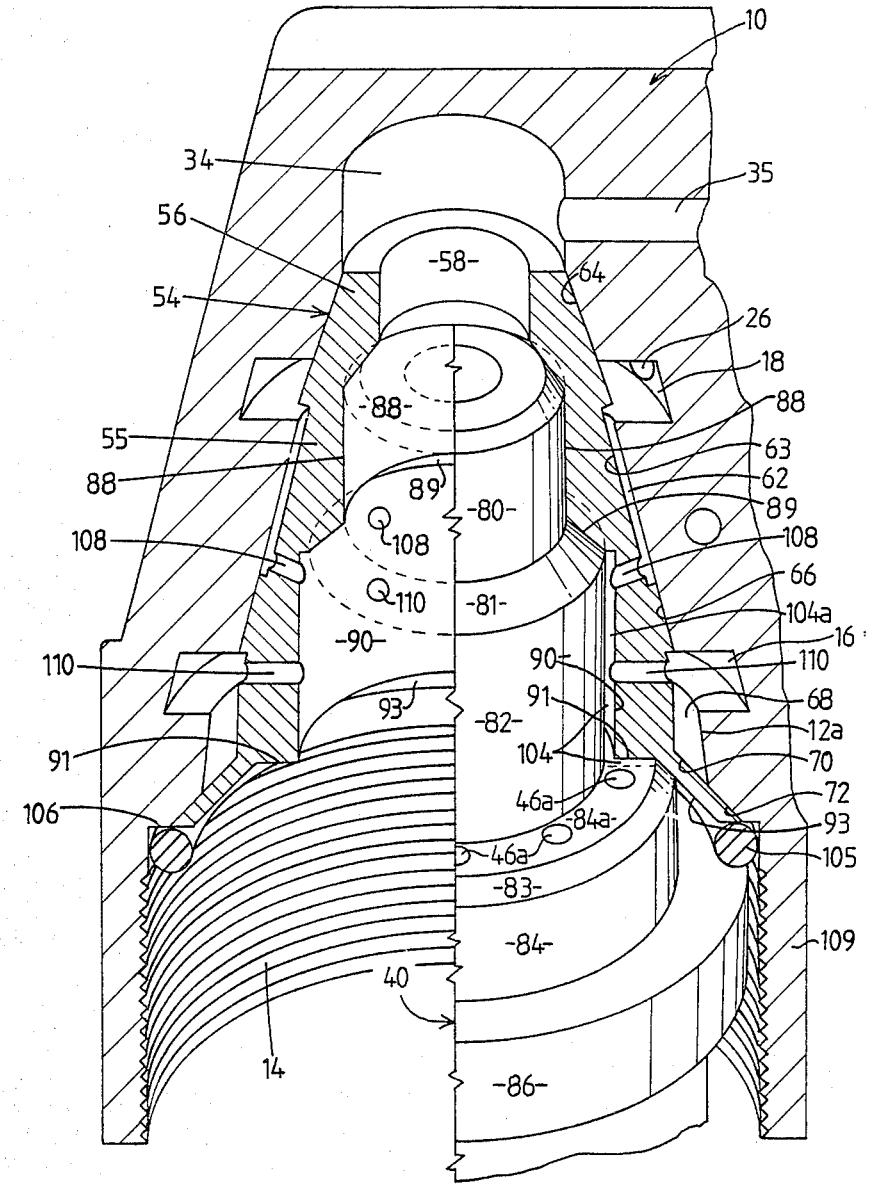
FIG. 7 is a cutaway perspective view showing the assembly of the head of FIG. 1, the tip of FIGS. 2 and 3, and the adaptor of FIG. 6.

Another chamber 68, of annular configuration, is also defined between the outer surface of adaptor 54 and the surface of recess 12 when the adaptor is in position as shown in FIG. 7. Chamber 68 is defined between, on the one hand, a groove 70 in the outer surface of the adaptor and, on the other hand the groove 16 in the head recess 12 together with an adjacent surface portion 12*a* of the head recess surface. In this regard, the groove 16 and groove 70 are roughly brought into alignment when adaptor 54 is inserted into the head. The chamber 68 is sealed at its upper end by engagement of the surface portion 66 on the adaptor 54 with the head recess as previously described and at its lower end by engagement of another portion 72 of the outer surface of the adaptor with the head recess.

Tip 40 at its end portion 42 has a series of stepped coaxial cylindrical portions 80, 82, 84 and 86 arranged in order of increasing diameter towards the nozzle end. When the tip is inserted into the adaptor 54, portion 80 is accommodated within a generally cylindrical interior surface portion 88 of the adaptor, whilst portion 82 is accommodated within a generally cylindrical interior surface portion 90 of the adaptor. Between portions 80 and 82 of tip 40 there is a frustoconical surface portion 81 which sealingly cooperates with a frustoconical sealing surface 89 on the adaptor between surface portions 88, 90 so as to confine cutting oxygen gas from part 34 to flow into the central opening 58 in the adaptor.

Portion 82 of tip 40 is of lesser radius than the radius of surface portion 90 of the adaptor so there is defined between these a gap 104*a*, preferably in the range 0.23 to 0.15 mm. This gap is closed at its upper end by engagement of the surface portion 81 on tip 40 with the corresponding surface 89 of adaptor 54 as described above and is also closed at its lower end by engagement between a sealing surface 83 at the upper periphery of portion 84 of tip 40 and which sealing surface engages a correspondingly frustoconical sealing surface 93 on the interior of the adaptor.

There is defined between the tip 40 and adaptor 54, a cavity 104 which includes the gap 104*a* between surface portion 82 on tip 40 and sealing surface 93 on adaptor 54. This cavity 104 is of annular generally cylindrical configuration over the major part of its length, corresponding to gap 104*a*. However, portion 82 of tip 40 is made somewhat longer than the corresponding interior surface portion 90 of the adaptor, the portion 84 of the tip being axially spaced below an outward going annular surface portion 91 on the adaptor between surface portions 90 and sealing surface 93 thereof. This surface portion 91 extends in generally parallel spaced relationship above and faces annular surface portion 84*a* on tip 40 the surface portion 84*a* itself extending between tip portion 82 and sealing surface 83 on tip 40. Thus, in transverse section the cavity 104 is somewhat L-shaped, extending from an upper location where it is sealed by engagement between surface portion 81 and sealing surface 89, down the side of portion 82 of the tip and thence outwardly above the surface portion 84*a* to the location where it is closed by sealing engagement between sealing surface 83 on tip 40 and the sealing surface 93 of the adaptor.

The adaptor 54 has a first series of passages 108 extending through the wall 55 thereof and a second series of apertures 110 also extending through the wall thereof. Arpertures 108 are equiangularly arrayed around the axis of the adaptor and provide communication between the bottom of the groove 63 and the top of the interior surface portion 90 of the adaptor. The passages 110 are likewise equiangularly arrayed about the axis of the adaptor and these provide communication between the base of the groove 70 and the surface portion 90. Passages 108 and 110 are each arranged to open to the top of the cavity 104. Passages 108 also open to the bottom of the chamber 62, whilst passages 110 also open to the top of the chamber 68.

As best seen in FIG. 7 of the bores 46 through the tip 40 open at ports 46*a* shown in FIG. 7 located on surface portion 82*a* to the base of the cavity 104.

In use with the adaptor 54 positioned as shown in FIG. 7, cutting oxygen is supplied to the bore 44 of tip 40 from port 34 and opening 58. Heating oxygen is supplied to the groove 18 in head 10 and thence flows down the chamber 62 between the head and adaptor, through the passages 108 in adaptor 54 into the cavity 104, down the cavity 104 between adaptor 54 and cylindrical portion 82 of cutting tip 40.

Combustible gas is supplied to chamber 68 between head 10 and adaptor 54, then passing through passages 110 in adaptor 54 to flow into cavity 104 to mix with combustible heating oxygen from groove 18. Cavity 104 thus provides the mixing chamber for the components of the heating gas mixture which then passes down the cavity 104 through ports 46*a* into the bores 46 of tip 40.

The combination of the tip, head and adaptor is characterized in that the mixed heating gas and oxygen must pass through the cavity 104 before admission to the ports 46*a*. Because of the configuration of cavity 104 the possibility of blow back (also known as back fire or flash back) into the head itself is minimized. The additional chamber 62 provides further protection in that likelihood of a combustion occurring by blow back through the oxygen supply line is minimized by the particular configuration of that chamber.

The adaptor 52 shown in FIG. 5 is generally similar to the adaptor 54 shown in FIG. 6 save that the groove 70 is of different configuration. Furthermore, in the arrangement of FIG. 6 there are six passages 108 and six passages 110 whereas in the arrangement of FIG. 5 there are twelve passages 108 and twelve passages 110.

The adaptor 50 of FIG. 4 differs from both the adaptor 52 and the adaptor 54 in that the groove 63 is made relatively longer in the axial direction so as to communicate with both of the grooves 16 and 18 of the head recess so that mixing of heating gas and oxygen occurs within a cavity defined between that groove and the surface of the recess in the head. In this case, only a single series of passages 112 is required leading from the exterior of the adaptor to the interior thereof, and mixed gas is applied directly to the cavity 104.

The adaptors described are easily insertable into and removable from the head and can be held in position without means additional to that usually employed for holding the tip in position. Thus, the tip 40 has, as is usual, a peripheral flange defined by portion 86 thereof and an annular externally threaded plug (not shown) is in use passed over the end portion 45 of the tip and screwed into a threaded skirt 10*a* on head 10, around recess 12, to tightly bear against the flange to hold the tip in the head. As shown a circular sealing ring 105 may be interposed between the flange formed by tip portion 86 and a surface 106 surrounding the mouth 14 of recess 12. The form of the adaptors described permits the tip and adaptor to both be held in position by the same means.

The described arrangement has been advanced merely by way of explanation and many modifications may be made thereto without departing from the spirit and scope of the invention as defined in the appended claims.

I claim:

1. An adaptor for interconnecting a three outlet cutting torch head with a two inlet cutting tip, said cutting head having an inwardly convergent recess therein and first, second and third outlet ports communicating with said recess for delivery of cutting oxygen, heating oxygen and combustible gas respectively to the recess of said head and said cutting tip having respective first and second inlet ports for cutting oxygen and a mixture of combustible gas and heating oxygen, said first and second inlet ports being on a tapered portion of the tip, said adaptor having an inwardly convergent recess for receiving said tapered portion of said tip and a tapered portion for fitment of the adaptor into said recess of the head; said adaptor being formed whereby in use with said tapered portion thereof inserted into said recess in said head and said tapered portion of said tip inserted into said recess of said adaptor, communication is provided, via first passageway means, between the first outlet port and the first inlet port and, via second passageway means, between both said second and third outlet ports and the second inlet port, said second passageway means having therein a first portion through which, in use, both of said combustible gas and heating oxygen flow, said first portion being elongate in the direction of flow therethrough and being of small cross-sectional size at least in one direction transverse to the direction of flow.

2. An adaptor as claimed in claim 1, wherein said second passageway means further includes a second portion through which in use at least said heating oxygen flows and which is elongate in the direction of flow of heating oxygen therethrough and which is of relatively small cross-sectional dimension in at least one direction transverse to the direction of flow therethrough.

3. An adaptor as claimed in claim 2, wherein the first said passageway portion is in use defined between said recess of the adaptor and said tapered portion of said tip and said second passageway portion is defined between the tapered portion of the adaptor and the recess of said head.

4. An adaptor as claimed in claim 3, wherein said adaptor is of generally conical form being annular in axial cross-section and having a peripheral wall defining at its inner surface the said recess of the adaptor and at its outer surface the said tapered portion thereof, said second passageway means including first and second series of passages defined in said adaptor and extending through the thickness of the said wall, for respective admission in use of heating oxygen and combustible gas to said first passageway portion, passages of said first and second series of passages communicating with a generally cylindrical inner surface portion of the said recess of the adaptor said cylindrical inner surface portion being adapted for co-operation with a cylindrical outer surface defined on said tapered portion of said tip, when the said portion is inserted into said recess of the adaptor, to define said first portion between the cylindrical inner surface portion and said cylindrical outer surface, whereby said first passageway portion is generally annular.

5. An adaptor as claimed in claim 4, wherein the adaptor recess defines frustoconical sealing surfaces axially spaced to either end of said cylindrical inner surface portion of the adaptor whereby in use of the adaptor to define, by co-operative engagement with said tapered portion of said tip, upper and lower bounds of said first passageway portion.

6. An adaptor as claimed in claim 5, wherein the exterior surface of said tapered portion of said adaptor has, at a location adjacent the first series of passages, a frustoconical groove for co-operation with a surface portion of the recess of said head, at which said second outlet opens, to in use define said second passageway as an annular space between the last-mentioned surface portion and said groove, said first series of passages communicating with said groove.

7. An adaptor as claimed in claim 6 including, at the exterior surface of said tapered portion thereof, three axially spaced sealing surfaces one being between the first and second series of passages where these passages communicate with the surface of said tapered portion of said adaptor and the other two of said three axially spaced sealing surfaces being at axially spaced locations away from the first and second series of passages, for co-operation with corresponding surfaces of the recess of the head said three axially spaced sealing surfaces being for sealing the first series of passages from the second series of passages and for sealing the passages of the first and second series from the atmosphere.

8. An adaptor as claimed in claim 7, wherein said adaptor has a passage, in use forming part of said first passageway means, the last-mentioned passage being formed at the tip of the adaptor and extending generally axially thereof for providing communication between an end surface of the tapered portion of the adaptor and an inner end surface of the recess of the adaptor and in use also providing communication between said first outlet and said first inlet.

* * * * *